US007737667B2

(12) United States Patent
Raedy

(10) Patent No.: US 7,737,667 B2
(45) Date of Patent: Jun. 15, 2010

(54) 3-PHASE ELECTRONIC TAP CHANGER COMMUTATION AND DEVICE

(75) Inventor: Steven M. Raedy, Clifton Park, NY (US)

(73) Assignee: Utility Systems Technologies, Inc., Niskayuna, NY (US)

( * ) Notice: Subject to any disclaimer, the term of this patent is extended or adjusted under 35 U.S.C. 154(b) by 232 days.

(21) Appl. No.: 11/249,831

(22) Filed: Oct. 13, 2005

(65) Prior Publication Data

US 2006/0082350 A1 Apr. 20, 2006

Related U.S. Application Data

(60) Provisional application No. 60/618,829, filed on Oct. 14, 2004.

(51) Int. Cl.
*G05F 1/20* (2006.01)

(52) U.S. Cl. ..... 323/258; 323/343; 323/353

(58) Field of Classification Search ..... 323/258, 323/343, 256, 257, 247, 259, 260, 261, 262–263, 323/341–342, 255, 340, 344, 64, 353; 363/64, 363/138, 160–162
See application file for complete search history.

(56) References Cited

U.S. PATENT DOCUMENTS

| | | | | | |
|---|---|---|---|---|---|
| 3,555,403 | A * | 1/1971 | Matzl et al. | ..... | 323/343 |
| 3,662,253 | A * | 5/1972 | Yamamoto | ..... | 323/343 |
| 3,786,337 | A * | 1/1974 | Kugler | ..... | 323/343 |
| 3,944,913 | A * | 3/1976 | Kugler | ..... | 323/258 |
| 4,622,513 | A * | 11/1986 | Stich | ..... | 323/343 |
| 5,006,784 | A * | 4/1991 | Sonntagbauer | ..... | 323/343 |
| 5,604,423 | A * | 2/1997 | Degeneff et al. | ..... | 323/258 |
| 5,604,424 | A * | 2/1997 | Shuttleworth | ..... | 323/258 |
| 5,694,034 | A * | 12/1997 | Dohnal et al. | ..... | 323/340 |
| 5,969,511 | A * | 10/1999 | Asselman et al. | ..... | 323/258 |
| 5,990,667 | A * | 11/1999 | Degeneff et al. | ..... | 323/258 |
| 6,087,738 | A * | 7/2000 | Hammond | ..... | 307/17 |
| 6,137,277 | A * | 10/2000 | Rajda et al. | ..... | 323/301 |
| 6,384,581 | B1 * | 5/2002 | Sen et al. | ..... | 323/211 |

* cited by examiner

*Primary Examiner*—Harry Behm
(74) *Attorney, Agent, or Firm*—Baker & Hostetler LLP

(57) ABSTRACT

The invention provides a novel 3-phase electronic tap changer commutation and related device. In one embodiment, the invention includes firing a commutation silicon controlled rectifier (SCR), removing a gating signal from a first SCR connected to a first of the plurality of taps, firing a second SCR connected to a second of the plurality of taps, and removing a gating signal from the commutation SCR.

9 Claims, 3 Drawing Sheets

3-PHASE ELECTRONIC TAP CHANGER COMMUTATION AND DEVICE

CROSS REFERENCE TO RELATED APPLICATIONS

This application claims the benefit of U.S. Provisional Patent Application Ser. No. 60/618,829, filed 14 Oct. 2004, which is hereby incorporated herein by reference.

BACKGROUND OF THE INVENTION (1) Field of the Invention

This invention applies to voltage regulators, and more particularly to a 3-phase alternating current (AC) electronic tap-changing voltage regulator. The present invention provides a specific transformer winding topology and commutation technique that improves performance and reduces cost compared to conventional methods.

(2) Background Art

Tap changing transformers are commonly used to regulate AC voltage in both low power, low voltage applications, and high power applications at distribution level voltages. Distribution level regulators typically consist of a multi-tapped transformer winding coupled to a mechanical tap changer so that regulation within +/−10% of nominal voltage is possible. These tap changer designs incorporate various mechanisms to ensure that, when transitioning from one tap to the next under load conditions, load current is not interrupted and arcing and inter-tap short circuit current are minimized.

In low voltage (e.g., less than about 1000V) and lower power applications (e.g., less than about 1 MVA) mechanical tap changers are often implemented using a simpler design incorporating a sliding commutation brush which can be positioned at arbitrary points along an exposed transformer winding in order to achieve the change in effective turns ratio. This technique has much lower cost than a discrete tap changer of the type used at higher power levels, but does not provide the same performance and also requires more maintenance.

Electronic tap changers are also commonly used in low voltage and low (e.g., less than about 1 kVA) to moderate (e.g., about 500 kVA) power levels. Referring now to FIGS. 1-3, three known devices are shown. In FIG. 1, an electronic tap changer 10 comprises an electronic switch 20, 22, 24 connected to each tap 12, 14, 16 of a multi-tapped transformer 40 or auto transformer. Typically, each switch 20, 22, 24 includes back-to-back connected silicon controlled rectifiers (SCRs) 30, due to their low cost, simplicity, and ruggedness. By actively selecting which SCRs 30 are firing (e.g., by using appropriate sensing and gating controls, for example), the effective turns ratio of the transformer 40 can be controlled, so that the output voltage may be varied for a constant input voltage (as supplied by an AC voltage source 50), or, in the case of a regulator, the output voltage may be made constant within a certain tolerance under conditions of varying input voltage. Tap changer 10 may include other components, as would be recognized by one of ordinary skill in the art, including, for example, ground connections 32, loads 34, etc.

An alternative implementation to the basic electronic tap changer 10 (FIG. 1) is shown in FIG. 2. Here, a series transformer secondary winding 60 reduces the current through the electronic switches 20, 22, 24, while increasing the voltage withstand capability of each switch.

In any SCR-based on load tap changer, provisions must be made to avoid both load current discontinuity and high inter-tap circulating current when commutating the load current from one set of active SCRs to another (i.e., making a tap change). This is the same fundamental problem which must be addressed in the design of high power, discrete mechanical-on-load tap changers. The unique problem in the case of SCR based tap changers is a result of the gating characteristics of SCRs. That is, SCRs may be turned on at any arbitrary time, but will only cease to conduct when the load current naturally falls to zero (normally once each electrical half cycle).

When commutating from an 'old' tap to a 'new' tap, if the new tap SCR is fired before the old tap SCR has ceased conducting, short circuit current will potentially flow between the two taps until the old tap SCR current flows through current zero. This current overload is potentially damaging to the SCRs and transformer windings, and may result in a voltage drop as the short circuit current flows through the source impedance. Conversely, if a delay is used such that the old tap SCR is allowed sufficient time to turn off and regain its voltage blocking ability before the new tap SCR is activated, the current discontinuity which exists during the delay period may result in damaging or unacceptable voltage transients for inductive loads.

Referring now to FIG. 3, this problem can be solved by adding a commutating current path 70 through an impedance element (e.g., commutation resistor 80). This is a basic representation of one of many methods commonly utilized in high power, mechanical tap changers. In a device according to FIG. 3, when commutating from tap 12 to tap 14, for example, the SCR pair 26 connected to the commutation resistor 80 is first gated, resulting in short circuit current between the two taps 12, 14, which is limited by resistor 80 to an acceptable level. After the tap 12 conducting SCR 20 has naturally ceased to conduct, the tap 14 SCRs 22, 26 may be fired after some delay but with no concern for a current discontinuity as the load current may continue to flow through the resistor 80 until the tap 14 SCRs 22, 26 are conducting, at which time the gate signals of SCR pair 26 are removed.

The wiring scheme of FIG. 3, or one of its known derivatives, could be implemented on each tap in a 3-phase regulator in order to implement an acceptable commutation scheme for all possible tap changes. The additional complexity of this scheme, however, results in a substantial additional cost which may render the entire device impractical, and the additional control complexity and parts count reduces the reliability of the device.

SUMMARY OF THE INVENTION

The invention provides a novel 3-phase electronic tap changer commutation and related device. In one embodiment, the invention includes firing a commutation silicon controlled rectifier (SCR), removing a gating signal from a first SCR connected to a first of the plurality of taps, firing a second SCR connected to a second of the plurality of taps, and removing a gating signal from the commutation SCR.

A first aspect of the invention provides a method of commutating between a plurality of taps in a voltage regulating device, the method comprising: firing a commutation silicon controlled rectifier (SCR); removing a gating signal from a first SCR connected to a first of the plurality of taps; firing a second SCR connected to a second of the plurality of taps; and removing a gating signal from the commutation SCR.

A second aspect of the invention provides a method for substantially maintaining a voltage in a voltage regulating device, the method comprising: firing a first back-to-back connected pair of silicon controlled rectifiers (SCRs) connected in series to a commutation resistor; removing a gating signal from a second back-to-back connected pair of SCRs, whereby a load current of the second back-to-back connected pair of SCRs is allowed to fall to zero; firing a third back-to-back connected pair of SCRs; and removing a gating signal from the first back-to-back connected pair of SCRs, whereby the commutation resistor and first back-to-back connected pair of SCRs cease to conduct current.

A third aspect of the invention provides an alternating current voltage regulating device comprising: a commutation resistor; a back-to-back connected pair of silicon controlled rectifiers (SCRs); and at least one phase transformer including a plurality of taps, wherein the commutation resistor and back-to-back connected pair of SCRs substantially maintain a voltage for a period when none of the plurality of taps is firing.

The illustrative aspects of the present invention are designed to solve the problems herein described and other problems not discussed, which are discoverable by a skilled artisan.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION

As noted above, the invention provides a novel 3-phase electronic tap changer commutation method and related device.

Figure 1:
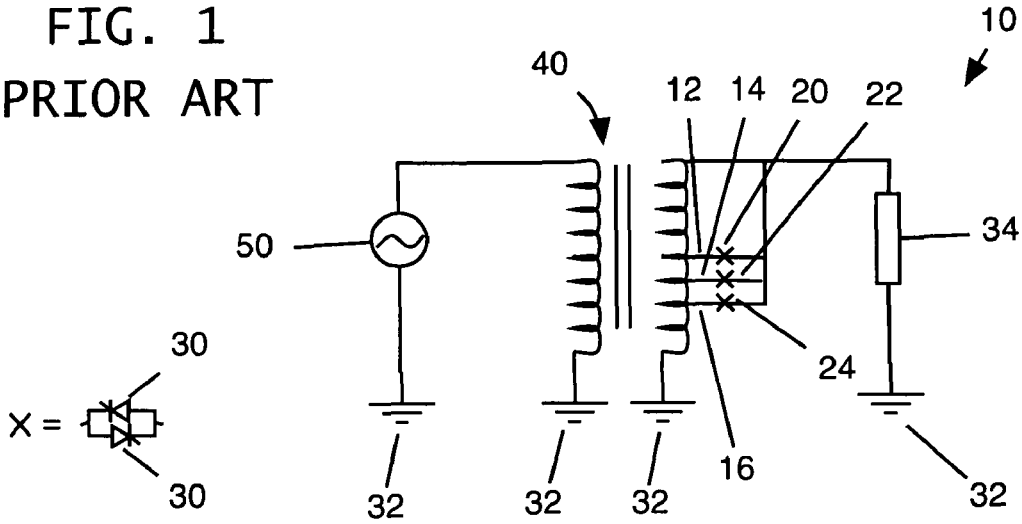
FIG. 1 PRIOR ART
FIGS. 1-3 show schematic diagrams of illustrative known devices.
Figure 2:
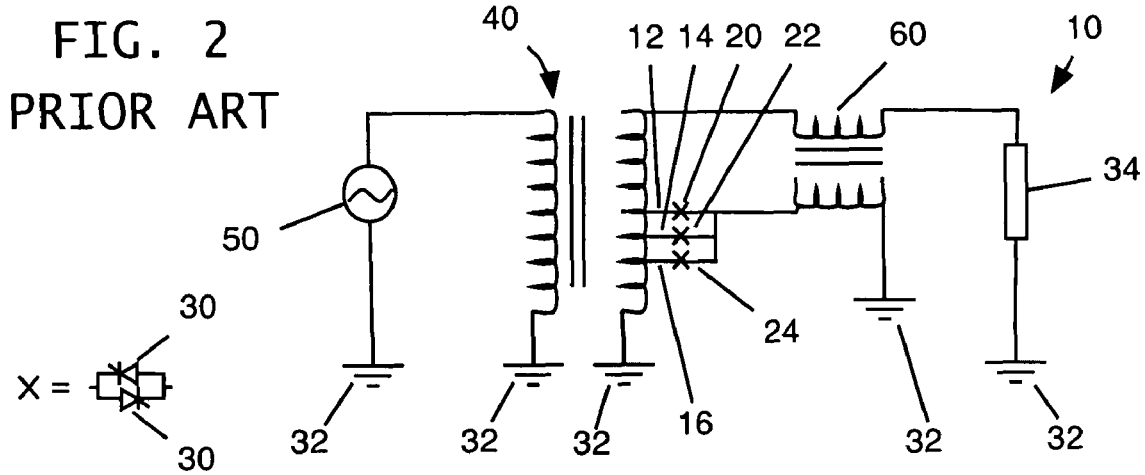
FIG. 2 PRIOR ART
Figure 3:
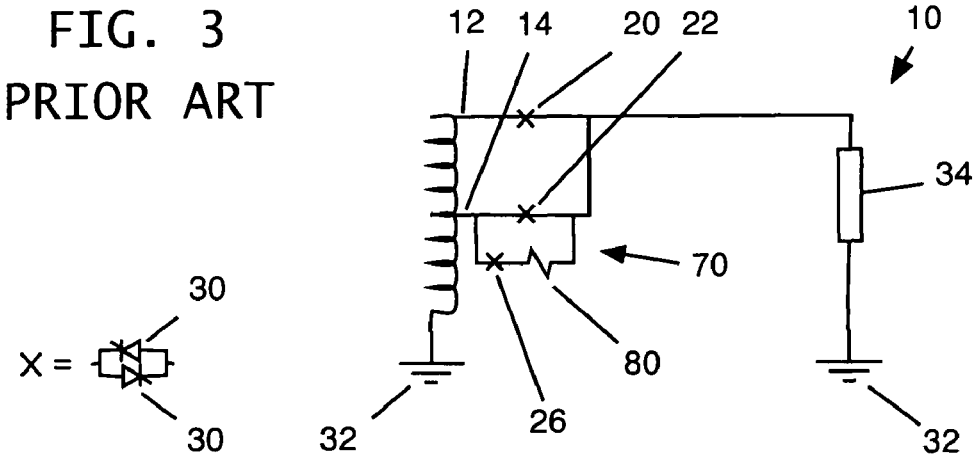
FIG. 3 PRIOR ART
Figure 4:
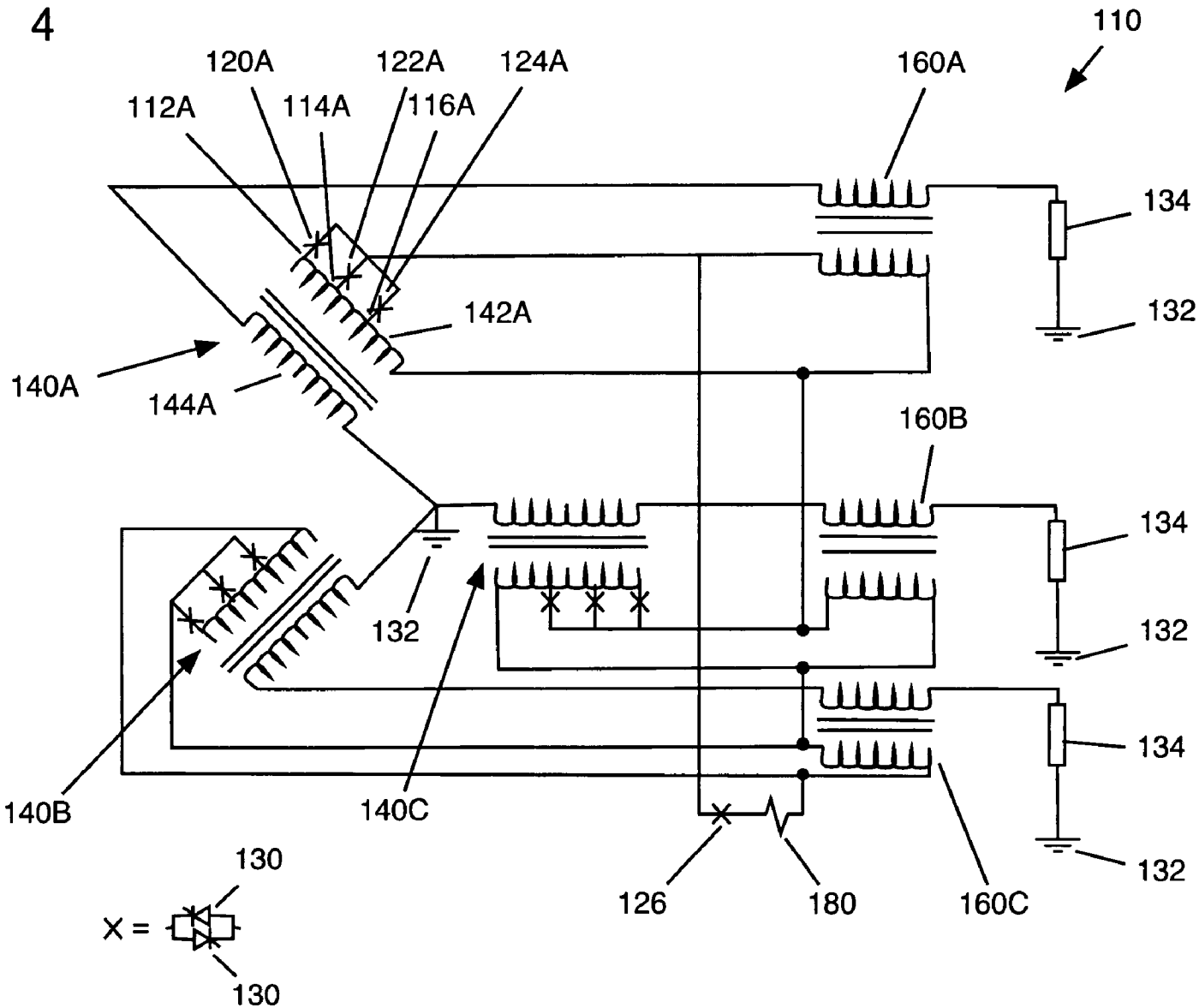
FIG. 4 shows a schematic diagram of an illustrative embodiment of the invention.

The present invention provides, inter alia, a topology and control method for implementing an acceptable commutation method on a 3-phase AC electronic voltage regulator using only a single commutation resistor and its associated SCR. The topology of the invention is shown in FIG. 4. For the sake of brevity, FIG. 4 shows only three tap selections 120A, 122A, 124A for one (i.e., 140A) of the three phases 140A-C. However, an actual implementation of the invention would typically contain additional taps. This basic topology utilizes series connected transformers 160A-C and also makes an additional modification to the basic topology by utilizing a tapped winding 142A that is separate from the main secondary winding 144A.

An analysis of this topology 110 reveals that the SCRs associated with any of the three phases 140A-C may be allowed to cease conducting as long as the commutation SCR 126 is fired. As such, a boost or buck voltage applied to the phase undergoing the commutation will equal the vectorial sum of the voltage being added to the other two phases, i.e., the sum of the voltage vectors across the other two buck/boost transformers. In a three-phase system, the boost or buck voltage required by all three phases is generally equal. Accordingly, the voltage buck or boost under this condition will generally be similar to the desired buck or boost under the normal condition in which the tap winding SCRs are conducting.

A control scheme can be implemented using the topology 110 of FIG. 4. Under normal conditions, the commutation SCR 126 is not being fired, so that each tap winding (e.g., 112A, 114A, 116A) is connected to its corresponding series transformer (e.g., 160A), and all of the current flowing through the primary windings of the series transformer (e.g., 160A) is carried by the tap windings of the corresponding transformer phase (e.g., 140A).

Figure 5:
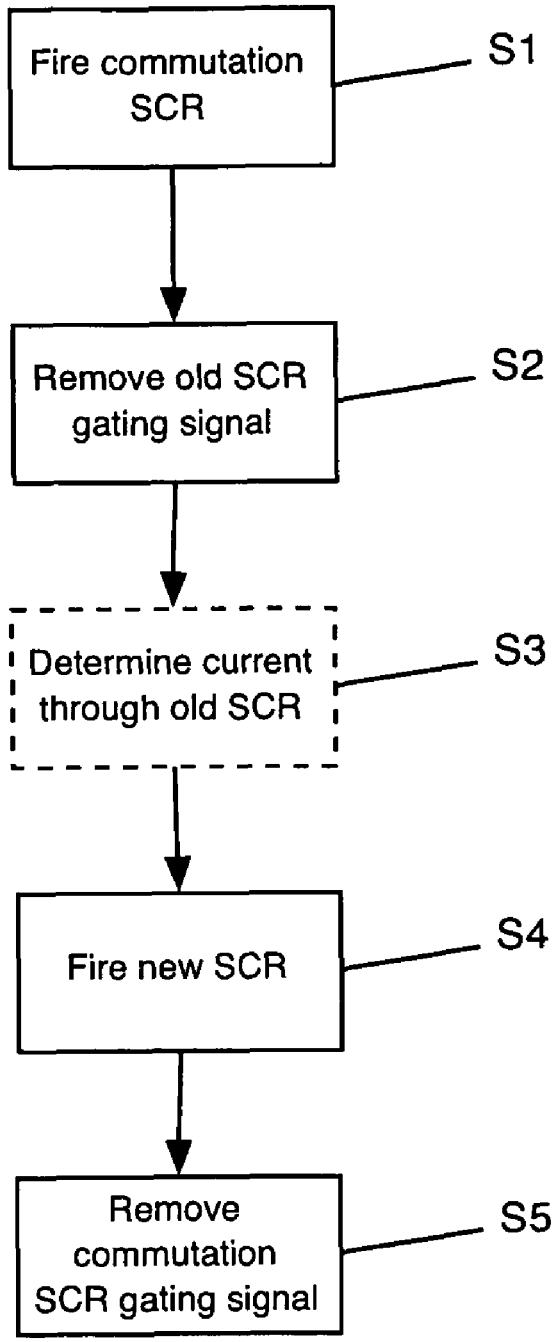
FIG. 5 shows a block diagram of an illustrative method according to the invention.

Referring now to FIG. 5, a block diagram of an illustrative method of commutating from an 'old' SCR pair (e.g., 120A in FIG. 4) to a 'new' SCR pair (e.g., 122A in FIG. 4) is shown. First, at step S1, the commutation SCR pair 126 (FIG. 4) is fired such that it remains in an AC conductive state. At this point, if the vectorial sum of the three individual phase voltages being applied to the three buck/boost transformers is non zero, a current will flow through the commutating resistor 180 (FIG. 4) equal to the vectorial sum of the three buck/boost voltages divided by the commutating resistance value in Ohms.

Next, at step S2, the gating signals to the 'old' SCR 120A are removed, so that its load current may be allowed to naturally fall to zero and the old SCR 120A ceases conducting current. At this point, the primary current of the series transformer 160A (FIG. 4) is supplied via the path which includes the commutating resistor 180 (FIG. 4) and SCR pair 126 (FIG. 4) and the tap windings of the other two phases 140B, 140C (FIG. 4).

At step optional step S3, a current through the old SCR 120A is determined, e.g., through any known or later-developed measurement method, to ensure that the current has reached zero. Alternatively, it may be assumed that the current has reached zero after a fixed delay time (typically ½ or more electrical cycle).

Next, at step S4, the 'new' SCR 122A is fired. Finally, at step S5, the gating signal to the commutation SCR 126 is removed, so that after a maximum of approximately ½ electrical cycle, the commutation SCR 126 and resistor 180 cease to conduct current.

The purpose of this scheme, as outlined with the single phase example above, is to provide a method for maintaining a continuous current through a series transformer associated with the phase undergoing a tap change and substantially maintaining the voltage across the primary winding during the commutation period, such that the voltage does not differ appreciably from the desired voltage.

The topology and method described herein require far fewer components and control complexity than would otherwise be required. That is, the present invention provides equal or similar performance to a scheme that utilizes a commutation resistor and SCR pair in conjunction with each tap winding SCR, but at greatly reduced cost and complexity.

It should be understood that the present invention works with switching solid-state semiconductor devices. Theses devices are synonymously know as Silicon Controlled Rectifiers (SCRs), anti-parallel SCRs, back-to-back SCRs, triode AC switches (triacs), gate turn-off thyristors (GTOs), static induction transistor (SITs), static induction thyristor (SITHs) or MOS-controlled thyristors (MCTs) and the present invention should not limited to the above named electronic switching devices.

The invention claimed is:

1. A method of commutating between a plurality of transformer taps in a voltage of at least one of a plurality of transformers in a regulating device, the method comprising:

using an open delta connection transformer device;

using a single commutation circuit;

monitoring an output with a controller;

maintaining continuity of current while maintaining an correct output voltage;

activating a commutation silicon controlled rectifier (SCR) of said single commutation circuit;

passing only a fraction of a load current through a commutation resistor;

removing a tap gating signal from a first SCR of a plurality of SCRs connected to a first tap of said plurality of transformer taps of said at least one plurality of transformers;

firing a second SCR of said plurality of SCRs connected to a second tap of said plurality of transformer taps; and deactivating said commutation SCR.

2. The method of claim 1, further comprises determining a first SCR current in said first SCR of a plurality of SCRs.

3. The method of claim 1, further comprises connecting each particular tap of said of said plurality of taps to a particular SCR of said plurality of said SCRs.

4. The method of claim 1, further comprises passing a current through a commutation resistor before removing a tap gating signal from said first SCR of a plurality of SCRs.

5. The method of claim 4, wherein said commutation current through said commutation resistor is equal to a vectorial sum of the voltages in each phase of the regulating device divided by a impedance of the commutation resistor.

6. The method of claim 1, further comprises:

disconnecting the first SCR of a the plurality of SCRs which is conducting current; and allowing the disconnected first SCR's current to current to fall to zero in response to polarity reversal of Alternating Current (AC).

7. The method of claim 1, wherein the voltage output from the regulating device is substantially maintained during commutation from the first of the plurality of taps to another tap of the plurality of taps.

8. The method of claim 1, wherein at least one SCR of said plurality of SCRs is replaced with a pair of back-to-back connected silicon controlled rectifiers.

9. A method for substantially maintaining an output voltage in a voltage regulating device, the method comprising:

using an open delta connection transformer device;

using a single commutation circuit;

firing a commutation back-to-back connected pair of silicon controlled rectifiers (SCRs) connected in series to a commutation resistor;

removing a gating signal from a first back-to-back connected pair of SCRs, whereby a load current of the first back-to-back connected pair of SCRs is allowed to fall to zero;

maintaining continuity of current while maintaining a correct output voltage;

firing a second back-to-back connected pair of SCRs; and removing a gating signal from the commutation back-to-back connected pair of SCRs, whereby the commutation resistor and commutation back-to-back connected pair of SCRs cease to conduct current; passing a current through the commutation resistor when said commutation back-to-back connected pair of SCRs are triggered, wherein said current flowing through the commutation resistor is equal to a vectorial sum of the voltages in each phase of the regulating device divided by an impedance of the commutation resistor.

* * * * *